US008572777B1

(12) United States Patent
Schulte

(10) Patent No.: US 8,572,777 B1
(45) Date of Patent: Nov. 5, 2013

(54) ADJUSTABLE BED BASE

(75) Inventor: John K Schulte, Lake St. Louis, MO (US)

(73) Assignee: Fredman Bros. Furniture Company, Inc., St. Louis, MO (US)

( * ) Notice: Subject to any disclaimer, the term of this patent is extended or adjusted under 35 U.S.C. 154(b) by 0 days.

(21) Appl. No.: 13/447,496

(22) Filed: Apr. 16, 2012

(51) Int. Cl.
*A47C 19/00* (2006.01)

(52) U.S. Cl.
USPC ..... 5/400; 5/183; 5/185; 5/286; 5/288

(58) Field of Classification Search
USPC ..... 5/400, 183, 185, 286, 288, 200.1, 201, 5/285; 403/382, 403, 295
See application file for complete search history.

(56) References Cited

U.S. PATENT DOCUMENTS

| | | | | | |
|---|---|---|---|---|---|
| 272,077 | A * | 2/1883 | Mueller | 5/183 |
| 1,329,202 | A * | 1/1920 | Novick | 5/183 |
| 1,394,512 | A * | 10/1921 | Tamarin et al. | 5/183 |
| 1,411,986 | A * | 4/1922 | Buda | 5/183 |
| 1,889,148 | A * | 11/1932 | Kurkchee | 5/183 |
| 4,007,502 | A * | 2/1977 | Mis | 5/202 |
| 4,679,261 | A * | 7/1987 | Stanley et al. | 5/183 |
| 4,724,559 | A | 2/1988 | Bly et al. | |
| 5,561,876 | A * | 10/1996 | Petruzella | 5/724 |
| 5,996,145 | A * | 12/1999 | Taylor | 5/200.1 |
| 6,338,172 | B1 * | 1/2002 | Taylor et al. | 5/200.1 |
| 6,381,777 | B1 | 5/2002 | Mitchell | |
| 6,397,413 | B2 | 6/2002 | Epstein et al. | |
| 7,861,339 | B2 | 1/2011 | Harrow | |
| 2004/0101358 | A1 * | 5/2004 | Odorico et al. | 403/403 |
| 2010/0175186 | A1 * | 7/2010 | Harrow | 5/400 |

* cited by examiner

*Primary Examiner* — Robert G Santos
*Assistant Examiner* — Richard G Davis
(74) *Attorney, Agent, or Firm* — David H. Chervitz

(57) ABSTRACT

An adjustable bed base is disclosed in which the adjustable bed base comprises a pair of opposed side members, an adjustable foot assembly and an adjustable head assembly with each assembly comprising a first panel adapted to be connected to one of the opposed side members, a second panel adapted to be connected to the other one of the opposed side members, and a central panel adapted to receive the first panel and the second panel with the first panel and the second panel being movable relative to the central panel to adjust a length of each of the assemblies.

20 Claims, 10 Drawing Sheets

ADJUSTABLE BED BASE

BACKGROUND

This disclosure relates to beds and bed frames and more particularly to an adjustable bed base for various sized mattresses.

Conventional beds may consist of a mattress, a box spring, a headboard, a foot board, a pair of spaced apart bed rails, and longitudinally spaced, transversely extending wooden or metal slats extending between the bed rails. The slats and the bed rails are used to support the mattress and box spring above the floor upon which the bed is positioned. Beds used in hotels have a bed base upon which the mattress and the box spring are placed. The bed base typically consists of a rectangular base formed by a pair of opposed sides, a foot side, and a head side connected together at the four corners of the rectangular base. Bed rails having a leg are also positioned on the opposed sides to span between the opposed sides. The four sides and the bed rails present surfaces upon which the box spring or mattress may be placed. Although such bed bases are useful one problem associated with their use is that different bed bases are required for different sized mattresses. In particular, one hotel room may have one queen size bed and another hotel room may have one king size bed. In this arrangement, it is required to have at least two different bed bases. One bed base must be used for the queen size bed and another bed base must be used for the king size bed. As can be appreciated, numerous parts or components must be purchased and inventoried for the various sized beds. Further, this problem is compounded in a hotel that has over a thousand rooms. If one hundred rooms need to be reconfigured from queen size beds to king size beds it is readily apparent that the queen size bed bases must be disassembled and removed from the rooms before a king size bed base can be installed. In view of this, an adjustable bed base could be employed to resolve this problem.

The present disclosure is designed to obviate and overcome many of the disadvantages and shortcomings associated with conventional fixed bed bases. In particular, the present disclosure provides an adjustable bed base that may be used to support various sized mattress. Moreover, the present disclosure is an adjustable bed base that also incorporates adjustable cross members that may be adjusted to accommodate various size of mattress. The present adjustable bed base is applicable for use with full, queen, California kings, and king size beds which can support the various different widths and weights of such beds.

SUMMARY

In one form of the present disclosure, an adjustable bed base comprises a pair of opposed side members, an adjustable foot assembly comprising a first foot panel adapted to be connected to one of the opposed side members, a second foot panel adapted to be connected to the other one of the opposed side members, and a central foot panel adapted to receive the first foot panel and the second foot panel with the first foot panel and the second foot panel being movable relative to the central foot panel to adjust a length of the foot assembly, and an adjustable head assembly comprising a first head panel adapted to be connected to one of the opposed side members, a second head panel adapted to be connected to the other one of the opposed side members, and a central head panel adapted to receive the first head panel and the second head panel with the first head panel and the second head panel being movable relative to the central head panel to adjust a length of the head assembly.

In another form of the present disclosure, an adjustable bed base comprises a first fixed side member, a second fixed side member, an adjustable foot assembly comprising a first foot panel adapted to be connected to the first fixed side member by a first corner connector assembly, a second foot panel adapted to be connected to the second fixed side member by a second corner connector assembly, and a central foot panel adapted to receive the first foot panel and the second foot panel with the first foot panel and the second foot panel being movable relative to the central foot panel to adjust a length of the foot assembly, and an adjustable head assembly comprising a first head panel adapted to be connected to the first fixed side member by a third corner connector assembly, a second head panel adapted to be connected to the second fixed side member by a fourth corner connector assembly, and a central head panel adapted to receive the first head panel and the second head panel with the first head panel and the second head panel being movable relative to the central head panel to adjust a length of the head assembly.

In yet another form of the present disclosure, an adjustable bed base is disclosed which comprises a first side member, a second side member, an adjustable foot assembly comprising a first foot panel adapted to be connected to the first fixed side member, a second foot panel adapted to be connected to the second fixed side member, a central foot panel adapted to receive the first foot panel and the second foot panel with the first foot panel and the second foot panel being movable relative to the central foot panel to adjust a length of the foot assembly, and a pair of indicators for identifying when the first foot panel and the second foot panel have been adjusted to a predetermined position, and an adjustable head assembly comprising a first head panel adapted to be connected to the first fixed side member, a second head panel adapted to be connected to the second fixed side member, a central head panel adapted to receive the first head panel and the second head panel with the first head panel and the second head panel being movable relative to the central head panel to adjust a length of the head assembly, and a pair of indicators for identifying when the first head panel and the second head panel have been adjusted to a predetermined position.

In light of the foregoing comments, it will be recognized that the present disclosure provides an adjustable bed base that may be adjusted to various widths to support and accommodate various sized mattresses.

The present disclosure provides an adjustable bed base which is of simple construction and design and can be easily employed and assembled with highly reliable results.

The present disclosure is also directed to an adjustable bed base that reduces the number of components required to be inventoried or transported to support various sized beds or mattresses.

The present disclosure also provides an adjustable bed base for supporting a mattress with the adjustable bed base employing lightweight structures or components that are easy to assemble, ship, or store.

The present disclosure provides an adjustable bed base that is capable of being installed without the use of any specialized tools.

The present disclosure provides an adjustable bed base that has metal center supports that are self positioning after the bed base has been assembled and correctly sized.

The present disclosure provides an adjustable bed base that has rigid center support which is required by mattress manufacturers for warranty compliance or protection.

The present disclosure also provides an adjustable bed base that can be shipped in a compact form and container.

The present disclosure provides an adjustable bed base that has increased strength, reliability, and durability.

The present disclosure also provides an adjustable bed base that comprises indicators for adjusting the bed base to a predetermined mattress size without the need to measure.

These and other applications and advantages of the present disclosure will become apparent after considering the following detailed specification in conjunction with the accompanying drawings, wherein

DETAILED DESCRIPTION OF EMBODIMENTS

Figure 1:
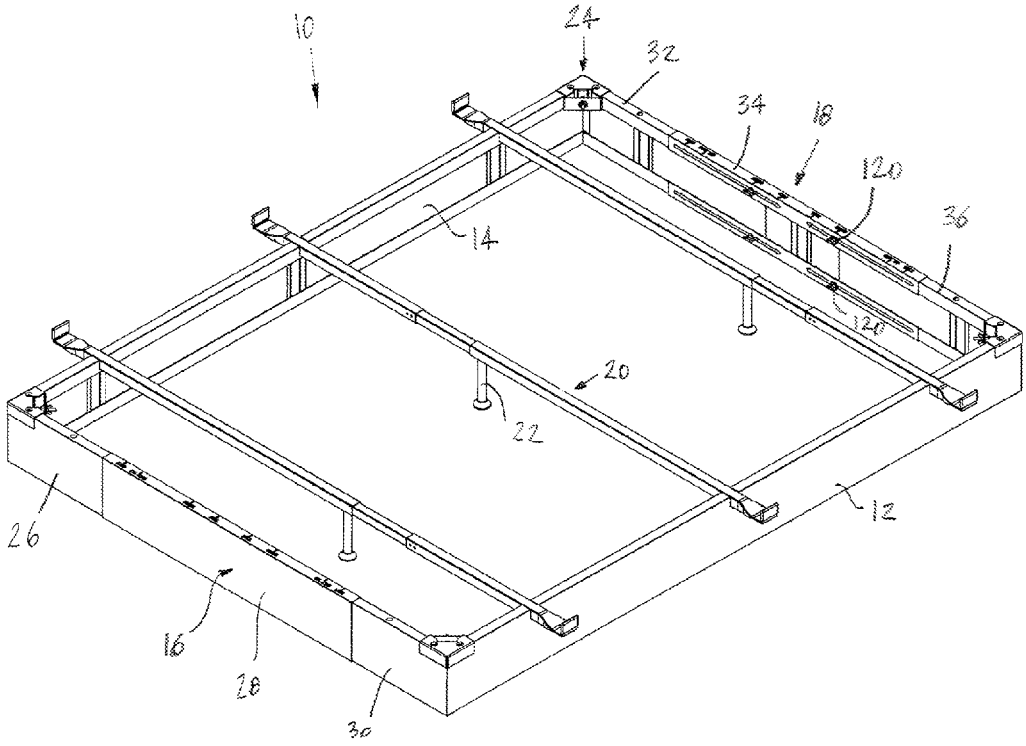
FIG. 1 is a perspective view of an embodiment of an adjustable bed base constructed according to the present disclosure.
Figure 2:
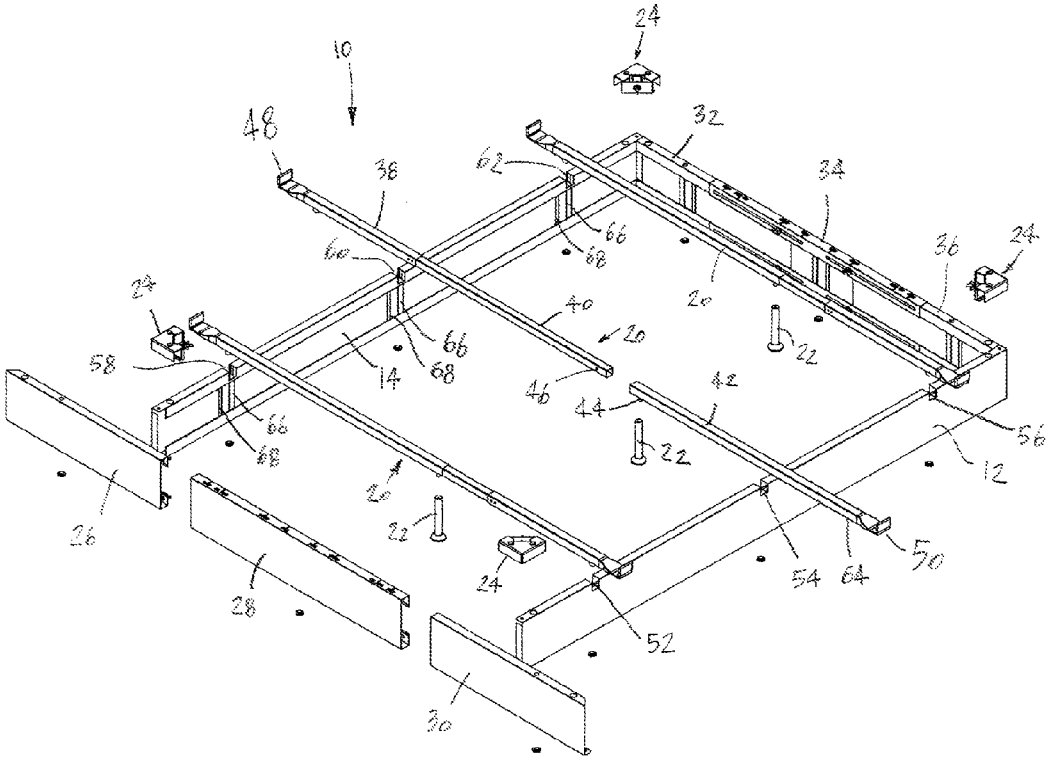
FIG. 2 is an exploded perspective view of the adjustable bed base constructed according to the present disclosure.

Referring now to the drawings, wherein like numbers refer to like items, number 10 identifies an embodiment of an adjustable bed base constructed according to the present disclosure. With reference now to FIGS. 1 and 2, the adjustable bed base 10 is shown comprising a first side panel 12, a second side panel 14, an adjustable foot assembly 16, an adjustable head assembly 18, three adjustable cross bar assemblies 20 having a support let 22, and four corner connector assemblies 24. As can be appreciated, the adjustable bed base 10 forms a rectangular base that is used to support a box spring or a mattress. The side panels 12 and 14 are of a fixed length and are opposed from each other. The foot assembly 16 and the head assembly 18 are adjustable in length and are adjusted to accommodate various sized mattresses. For example, the adjustable bed base 10 may be adjusted to support a full, queen, California king, or king sized bed. By further way of example, a full size mattress may have a width of 54", a queen size mattress may have a width of 60", a California king size mattress may have a width of 72", and a king size mattress may have a width of 78". As can be appreciated, the adjustable bed base 10 may be used to accommodate any sized mattress by adjustment of the foot assembly 16 and the head assembly 18.

The adjustable foot assembly 16 comprises a first foot panel 26, a central foot panel 28, and a second foot panel 30. The first foot panel 26 is adapted to be connected to the second side panel 14. The second foot panel 30 is adapted to be connected to the first side panel 12. The manner of connection of the foot panels 26 and 30 to the respective side panels 12 and 14 will be discussed in detail further herein. The central foot panel 28 is adapted to receive the first foot panel 26 and the second foot panel 30. There is a sliding engagement of the foot panels 26 and 30 within the central foot panel 28. The first foot panel 26 and the second foot panel 30 are movable relative to the central foot panel 28 to adjust a length of the foot assembly 16.

The adjustable head assembly 18 comprises a first head panel 32, a central head panel 34, and a second head panel 36. The first head panel 32 is adapted to be connected to the second side panel 14. The second head panel 36 is adapted to be connected to the first side panel 12. The manner of connection of the head panels 32 and 36 to the respective side panels 12 and 14 will be discussed in detail further herein. The central head panel 34 is adapted to receive the first head panel 32 and the second head panel 36. There is a sliding engagement of the head panels 32 and 36 within the central head panel 34. This sliding engagement allows the head panels 32 and 36 to be adjusted relative to the central head panel 34 to adjust a length of the head assembly 18.

With particular reference now to FIG. 2, one of the adjustable cross bar assemblies 20 is shown in an exploded view. The adjustable cross bar assembly 20 comprises a first bar member 38, a center bar member 40, a second bar member 42, and a connector member 44. The center bar member 40 is adapted to fit within the first bar member 38 and the second bar member 42 to adjust a length of the cross bar assembly 20. The first bar member 38 and the second bar member 42 may have a rectangular cross section and the central bar member 40 may also have a rectangular cross section that is smaller than that of the bar members 38 and 42. In this manner, the central bar member 40 may fit within the bar members 38 and 42. The first bar member 38 is connected to the center bar member 40. The center bar member 40 is free to move within the second bar member 42 to facilitate adjustment of the assembly 20. The bar members 40 and 42 may include stops 46 that may be used to adjust the length of the cross bar assembly 20 to a predetermined length. For example, one stop 46 may be used to adjust the length to the width of a queen size mattress and another one of the stops 46 may be used to adjust the length of the cross bar assembly 20 to the width of a king size mattress. Further, the bar member 42 may have apertures formed therein at predetermined positions to allow the stops 46 to fit therein. The stops 46 may be a spring loaded pin device. In this manner, the apertures can be used to identify where the bar member 42 needs to be adjusted to accommodate for different size beds or mattresses. It is further contemplated that the bar member 42 may have indicators to identify the different size beds or mattress. For example, the bar member 42 may have an indicator to identify where the member 42 needs to be positioned for a queen size bed. The connector member 44 is used to accept the support leg 22. The connector member 44 may be a screw type connector with the support leg 22 being screwed on to the member 44. Although the adjustable cross bar assembly 20 has been described as having three members 38, 40, and 42, it is also possible that the assembly 20 may be constructed using only two members.

The first bar member 38 has a stop member 48 and the second bar member 42 has a stop member 50. The stop members 48 and 50 are used to hold a box spring or a mattress in place that is positioned on the bed base 10. The stop members 48 and 50 assist in preventing a box spring or a mattress from moving or sliding off of the bed base 10. The first side panel 12 has notches 52, 54, and 56 formed therein. The second side panel 14 also has notches 58, 60, and 62 formed therein that oppose the notches 52, 54, and 56, respectively. The notches 52, 54, 56, 58, 60, and 62 are used to receive the adjustable cross bar assemblies 20. It is also possible that the notches 52, 54, 56, 58, 60, and 62 may include a receiving aperture (not shown) that can receive a peg member 64 associated with the second bar member 42. In this manner, the peg member 64 can be inserted into the receiving aperture for further securing the adjustable cross bar assembly 20 to the first side panel 12. Alternately, the peg member 64 may abut against an exterior side of the first side panel 12 or fit into the notches 52, 54, and 56 of the first side panel 12 to hold the cross bar assembly 20 in place. As can be appreciated, a peg member 64 may also be provided on the first bar member 38 to secure the first bar member 38 to the second side panel 14. Also, to add strength to the side panels 12 and 14, support ribs 66 and 68 may be formed in the side panels 12 and 14 where the notches 52, 54, 56, 58, 60, and 62 are located.

Figure 3:
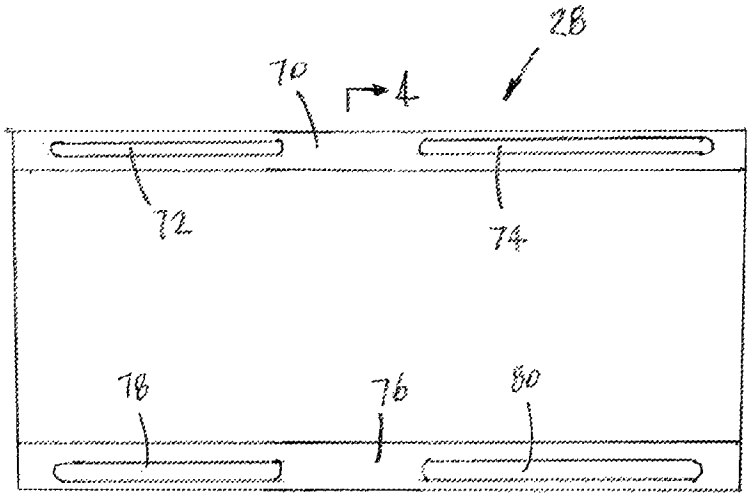
FIG. 3 is a front view of a central panel constructed according to the present disclosure.

FIG. 3 illustrates a front perspective view of the central foot panel 28. The central foot panel 28 has an upper side 70 that has a pair of slots 72 and 74. A lower side 76 is also part of the central foot panel 28 and the lower side 76 has a pair of slots 78 and 80. As was previously indicated, the central foot panel 28 is adapted to receive the first foot panel 26 and the second foot panel 30 in that the first foot panel 26 and the second foot panel 30 slide into the central foot panel 28. The slots 72, 74, 78, and 80 are used to align and position the first foot panel 26 and the second foot panel 30 within the central foot panel 28.

Figure 4:
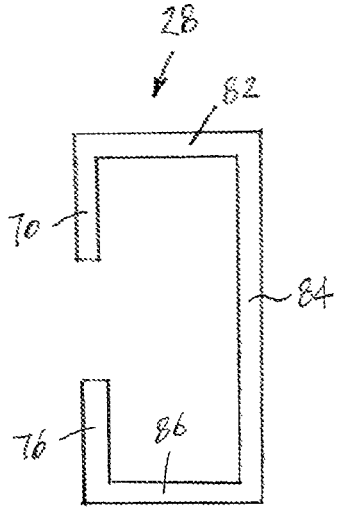
FIG. 4 is a cross-sectional view of the central panel shown in FIG. 3 taken along the plane of line 4-4.

Referring now to FIG. 4, a cross-sectional view of the central foot panel 28 is depicted. The central foot panel 28 has the upper side 70 connected to a top side 82 which is in turn connected to a side 84. The lower side 76 is connected to a bottom side 86 which is connected to the side 84. In this manner, the central foot panel 28 has a C-shaped cross section which facilitates movement of the first foot panel 26 and the second foot panel 30 within the central foot panel 28.

Figure 5:
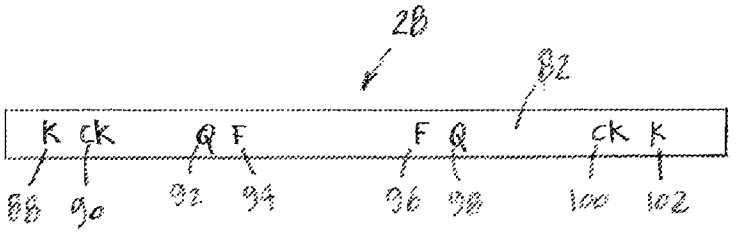
FIG. 5 is a top view of the central panel shown in FIG. 3.

FIG. 5 shows a top view of the central foot panel 28. The top side 82 has indicators 88, 90, 92, 94, 96, 98, 100, and 102 positioned or formed on the top side 82. The indicators 88, 90, 92, 94, 96, 98, 100, and 102 function to identify when the first foot panel 26 and the second foot panel 30 have been adjusted to a predetermined mattress size or position. For example, the indicators 88 and 102 identify when the first foot panel 26 and the second foot panel 30 have been adjusted within the central foot panel 28 to accommodate a king size mattress or bed. The indicators 90 and 100 identify an adjustment used to accommodate a California king size mattress or bed, the indicators 92 and 98 identify an adjustment used to accommodate a queen size mattress or bed, and the indicators 94 and 96 identify an adjustment used to accommodate a full size mattress or bed. In this manner, a pair of the indicators 88 and 102, 90 and 100, 92 and 98, or 94 and 96 are used to gauge when a predetermined mattress or bed size has been accomplished.

Figure 6:
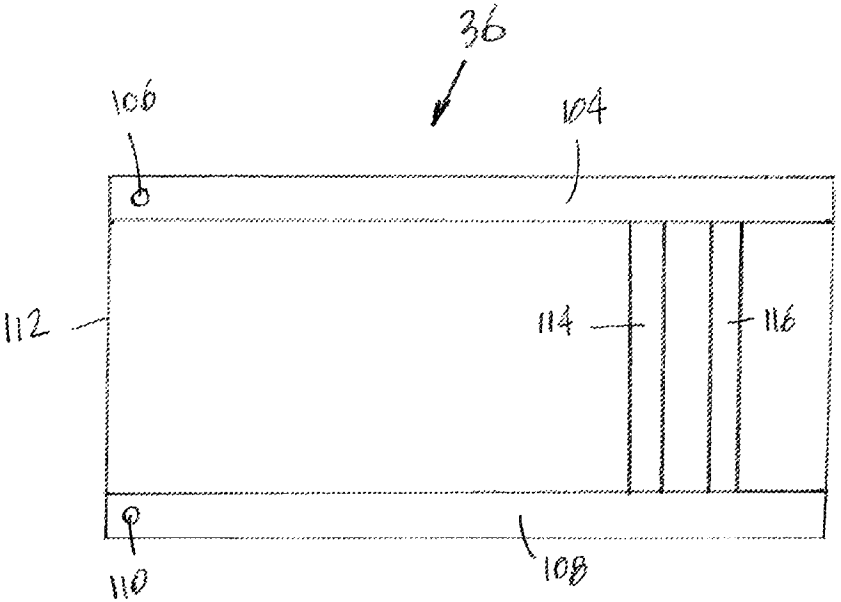
FIG. 6 is a front view of a panel constructed according to the present disclosure.

With reference to FIG. 6, a front perspective view of the second foot panel 30 is illustrated. The second foot panel 30 has an upper side 104 having an aperture or a slot 106 and a lower side 108 having an aperture or a slot 110. The apertures 106 and 110 are used to align with the slots 74 and 80 of the central foot panel 28. The second foot panel 30 has a side edge 112. The side edge 112 may be used to be aligned with the indicators 96, 98, 100, and 102 to indicate when the second foot panel 30 has been properly positioned relative to the central foot panel 28. The second foot panel 30 may also include a pair of reinforcing rib members 114 and 116 to add strength and rigidity to the second foot panel 30.

Figure 7:
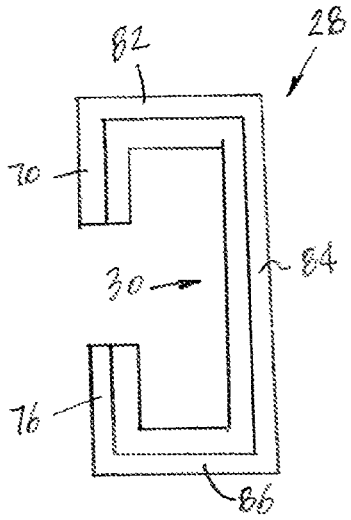
FIG. 7 is a cross-sectional view of the panel nested within the central panel.

FIG. 7 shows a cross-sectional view of the second foot panel 30 nested within the central foot panel 28. The second foot panel 30 is C-shaped in cross section and the cross section is smaller than the C-shaped cross section of the central foot panel 28. In this manner, the second foot panel 30 is easily moved or repositioned within the central foot panel 28. As can be appreciated, the other panels 26, 32, and 36 are similar in shape and construction as the second foot panel 30. Further, the central head panel 34 is similar in shape and construction as the central foot panel 28. In particular, the central head panel 34 has a C-shaped cross section with allows the first head panel 32 and the second head panel 36 to slide or move within the central head panel 34 to adjust the panels 32, 34, and 36 to a desired position to accommodate any size bed or mattress. Also, once the panels 26, 28, and 30 or the panels 32, 34, and 36 are adjusted to a predetermined position, a locking device 120 (FIG. 1) may, for example, be positioned in the slots 74 and 106 and the slots 80 and 110 to secure the panels 28 and 30 together to prevent movement. The locking device 120 may be a bolt and a wing nut or any other device or mechanism that allows the panels to be secured to each other.

Figures 8, 9, 10, 11:
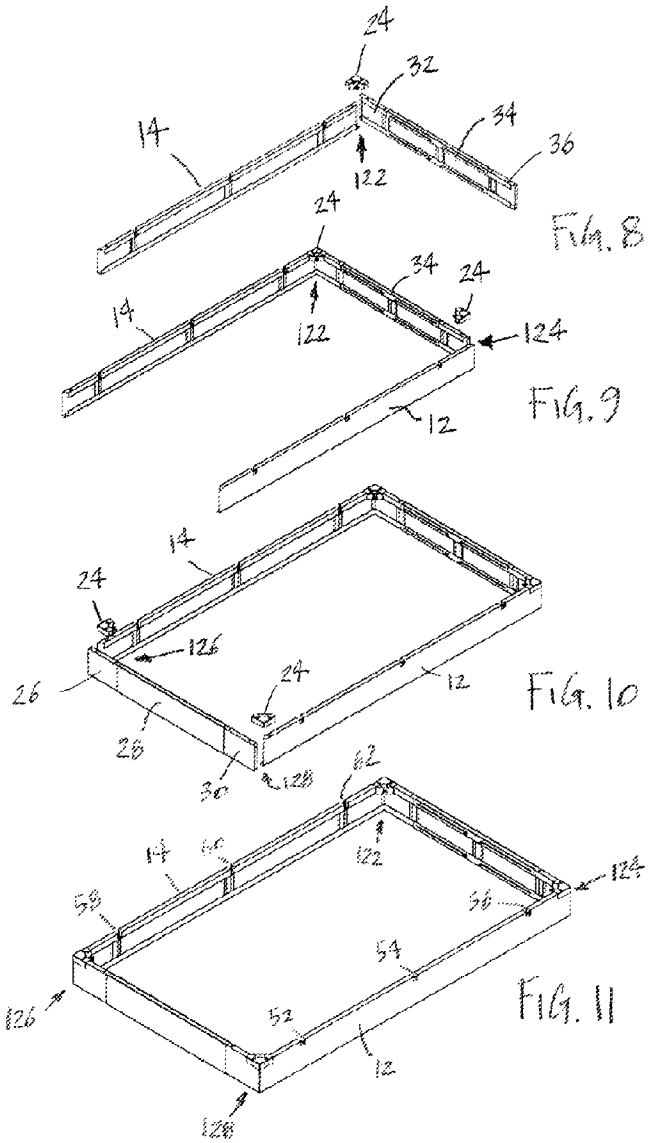
FIG. 8 is a partial perspective view of a panel prior to being placed on a side panel.
FIG. 9 is a partial perspective view of the panel and side panel being placed together and prior to a portion of a corner connector assembly being positioned on the panel and the side panel.
FIG. 10 is a partial perspective view of the panel and the side panel being placed together and prior to another portion of the corner connector assembly being installed.
FIG. 11 is a partial perspective view of the corner connector assembly being fully connected to the panel and the side panel.

The bed base 10 may be used to support any size bed or mattress. As can be appreciated, only one bed base 10 is needed to support any size bed or mattress. Due to the construction of the bed base 10 of the present disclosure, only one bed base 10 is required by a customer. In essence, only a few components are needed to assembly one complete bed base 10. In order to assembly the bed base 10 the following assembly steps may be used. In a first step, as shown in FIG. 8, the first head panel 32 and the second head panel 36 are inserted into the central head panel 34 and adjusted to a desired position by use of the indicators 88, 90, 92, 94, 96, 98, 100, and 102. Once adjusted, locking devices 120 are inserted into aligned slots to secure the panels 32 and 36 to the panel 34. Once the panels 32, 34, and 36 are fully assembly the second side panel 14 is connected to the panel 32 to form a corner 122. A corner connector assembly 24 is positioned on the corner 122 to secure the panel 32 to the second side panel 14. In a next suggested step, FIG. 9, the first side panel 12 is connected to the second head panel 36 to form a corner 124. A corner connector assembly 24 is positioned on the corner 124 to secure the panel 36 to the first side panel 12. In FIG. 10, the first foot panel 26 and the second foot panel 30 has been inserted into the central foot panel 28 and adjusted to a desired position. Locking devices 120 are employed to secure the panels 26, 28, and 30 together. The panels 26 and 30 are then connected to the side panels 14 and 12, respectively. The connection between the panel 26 and the side panel 14 forms a corner 126 and the connection between the panel 30 and the side panel 12 forms a corner 128. Once connected, corner connecting assemblies 24 are used to further secure the panels 26 and 30 to the side panels 14 and 12, as is shown in FIG. 11.

Also, the corners 122, 124, 126, and 128 are all square and the bed base 10 generally forms a rectangular shape. The cross bar members 20 will be adjusted to the desired size and then have the support legs 22 connected thereto. The cross bar members 20 may then be positioned in opposed notches, such as notches 52 and 58, 54 and 60, or 56 and 62 to complete the assembly of the adjustable bed base 10. In order to disassemble the bed base 10, the above suggested steps may be reversed.

Further, there may be times when a different size bed or mattress may be required in a room. In this situation, the current mattress may be removed from the bed base 10 and the bed base 10 may then be readjusted accordingly. By way of example only, the locking devices 120 may be loosened and then the foot panels 26 and 30 and the head panels 32 and 36 may be adjusted to the desired position by use of the indicators 88, 90, 92, 94, 96, 98, 100, and 102. Once the panels 26, 30, 32, and 36 are repositioned, the locking devices 120 may be tightened to secure the panels 26, 28, 30, 32, 34, and 36. The cross bar members 20 will then be readjusted and the new mattress or bed may then be placed on the adjustable bed base 10.

Figure 12:
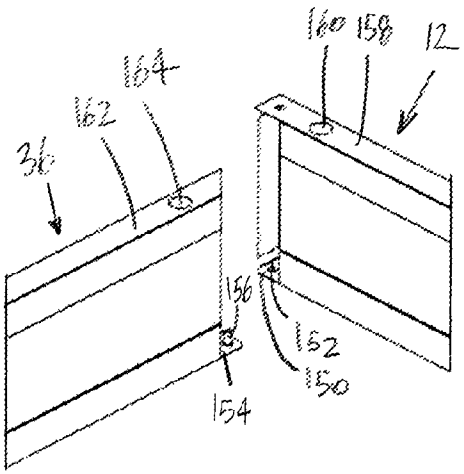
FIG. 12 is a perspective view of a side panel being connected to an adjustable head assembly and prior to a corner connector assembly being positioned on the side panel and the adjustable head assembly.

FIG. 12 shows the first side panel 12 prior to being connected to the second head panel 36. The first side panel 12 has a bottom plate 150 having an aperture 152. The second head panel 36 has a bottom plate 154 having a pin member 156. The bottom plate 150 of the first side panel 12 is adapted to be placed over the bottom plate 154 of the second head panel 36 to allow the pin 156 to pass through the aperture 152. In this manner, the first side panel 12 and the second head panel 36 are connected together to form the corner 124 (FIG. 9). The first side panel 12 also has a top plate 158 having an aperture 160. The second head panel 36 also has a top plate 162 having an aperture 164. The use of the apertures 160 and 164 will be explained more fully herein.

Figure 13:
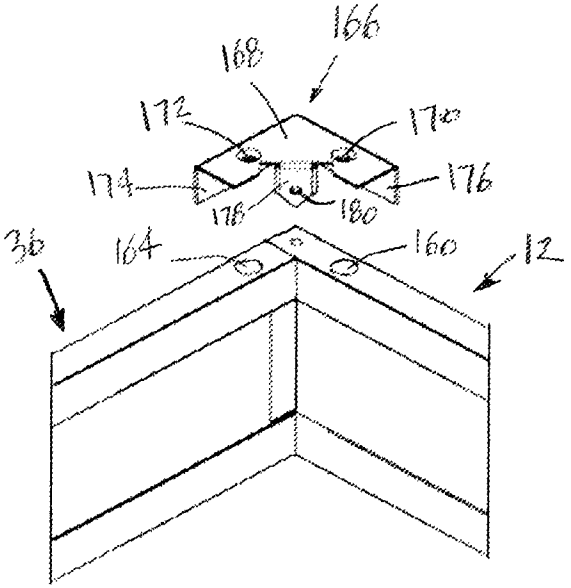
FIG. 13 is a perspective view of the another side panel being connected to the adjustable head assembly and prior to a corner connector assembly being positioned on the side panel and the adjustable head assembly.

Reference is now directed to FIG. 13 in which a corner connector 166 of one of the corner connector assemblies 24 is about to be placed over the first side panel 12 and the second head panel 36. The corner connector 166 has a top 168 having a pair of projections 170 and 172 that extend downwardly from the top 168. The projections 170 and 172 are sized and shaped to align with and fit within the aperture 160 and the aperture 164, respectively. The corner connector 166 also has a pair of walls 174 and 176 and a central portion 178 having an aperture 180. The aperture 180 may be a threaded aperture.

Figure 14:
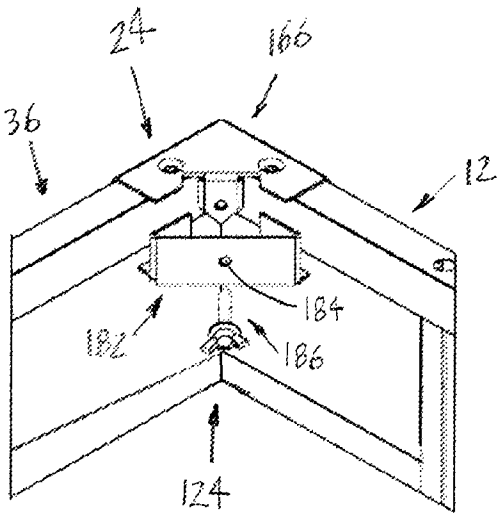
FIG. 14 is a perspective view of an adjustable foot assembly just prior to being connected to the side panels and prior to a pair of corner connector assemblies being positioned on the side panels and the adjustable foot assembly.
Figure 15:
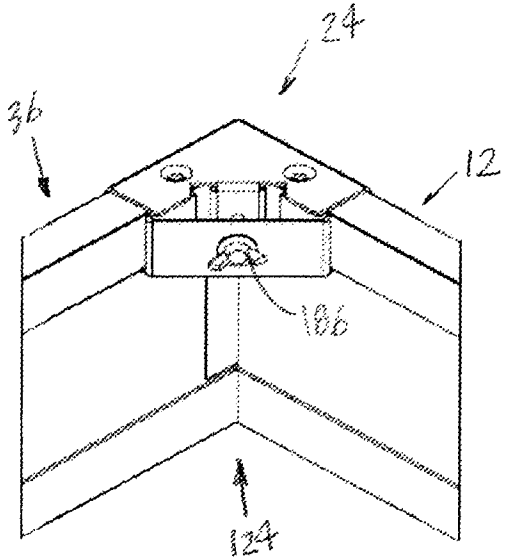
FIG. 15 is a perspective view of the bed base without the cross bar members being installed.

FIG. 14 depicts the corner connector 166 being placed over the first side panel 12 and the second head panel 36. The corner connector assembly 24 also has a central connector 182 having an aperture 184 and a securing device 186. The securing device 186 may be a threaded bolt or a bolt having a head at one end and a threaded end at the other end for accepting a wing nut. The central connector 182 is placed against the central portion 178 of the corner connector 166 and the securing device 186 is inserted through the aperture 184 and into the aperture 180. The securing device 186 is tightened and the corner connector assembly 24 is secured in place in the corner 124 to further connect the first side panel 12 to the second head panel 36, which is illustrated in FIG. 15. As can be appreciated, the other corner connector assemblies 24 are used to connect the other panels together to form the other corners 122, 126, and 128 of the bed base 10.

The side members 12 and 14 are generally rectangular in shape and may be formed of sheet metal using any known techniques. For example, the side members 12 and 14 may be made from roll formed sheet metal having a thickness from about 16 to 20 gauge. The panels 26, 28, 30, 32, 34, and 36 are generally rectangular in shape and may be formed of sheet metal. The panels 26, 28, 30, 32, 34, and 36 may be constructed out of roll formed sheet metal having the same thickness as the side members 12 and 14. In this manner, the adjustable bed base 10 may be lightweight, strong, and rigid. This allows the bed base 10 to be easily assembled, disassembled, and positioned within a room. The adjustable cross bar assemblies 20 may be formed of a hollow rectangular bar that allows the bar member 40 to fit within the bar members 38 and 42. Further, the bed base 10 of the present disclosure can be shipped as a single kit. The bed base 10 for any size bed or mattress can be assembled using a single kit.

From all that has been said, it will be clear that there has thus been shown and described herein an adjustable bed base which fulfills the various advantages sought therefore. It will become apparent to those skilled in the art, however, that many changes, modifications, variations, and other uses and applications of the subject adjustable bed base are possible and contemplated. All changes, modifications, variations, and other uses and applications which do not depart from the spirit and scope of the disclosure are deemed to be covered by the disclosure, which is limited only by the claims which follow.

What is claimed is:

1. An adjustable bed base comprising:

a first opposed side member having a first notch formed therein;

a second opposed side member having a first notch formed therein an adjustable foot assembly comprising a first foot panel adapted to be connected to the first opposed side member by a corner connector assembly, a second foot panel adapted to be connected to the second opposed side member, and a central foot panel adapted to receive the first foot panel and the second foot panel with the first foot panel and the second foot panel being movable relative to the central foot panel to adjust a length of the foot assembly;

an adjustable head assembly comprising a first head panel adapted to be connected to the first opposed side member, a second head panel adapted to be connected to the second opposed side member, and a central head panel adapted to receive the first head panel and the second head panel with the first head panel and the second head panel being movable relative to the central head panel to adjust a length of the head assemblys;

an adjustable cross bar assembly for positioning in the first notch of the first opposed side member and in the first notch of the second opposed side member; and the corner connector assembly comprising a corner connector having a top having a pair of projections extending downwardly from the top, a pair of walls extending downwardly from the top, a central portion extending downwardly from the top with the central portion having an aperture, a central connector having an aperture, a locking device for connecting the central portion to the corner connector.

2. The adjustable bed base of claim 1 wherein the central foot panel comprises a slot and the first foot panel comprises a slot with both of the slots being configured to align with each other.

3. The adjustable bed base of claim 2 further comprising a locking device adapted to be inserted into each of the slots for securing the central foot panel to the first foot panel.

4. The adjustable bed base of claim 1 wherein the adjustable cross bar assembly further comprises a peg member for fitting into the first notch of the first opposed member.

5. The adjustable bed base of claim 1 wherein the adjustable cross bar assembly comprises a first member and a second member with the first member fitting in the second member to adjust a length of the adjustable cross member.

6. The adjustable bed base of claim 5 further comprising a leg member adapted to be connected to the adjustable cross bar assembly to support the adjustable cross bar assembly.

7. The adjustable bed base of claim 1 further comprising a corner connector assembly adapted to connect the first foot panel and one of the opposed side members together.

8. The adjustable bed base of claim 1 wherein the central head panel comprises a pair of slots and the first head panel comprises a pair of apertures with each of the slots being configured to align with each of the apertures.

9. An adjustable bed base comprising:

a first fixed side member;

a second fixed side member;

an adjustable foot assembly comprising a first foot panel adapted to be connected to the first fixed side member by a first corner connector assembly, a second foot panel adapted to be connected to the second fixed side member by a second corner connector assembly, and a central foot panel adapted to receive the first foot panel and the second foot panel with the first foot panel and the second foot panel being movable relative to the central foot panel to adjust a length of the foot assembly;

an adjustable head assembly comprising a first head panel adapted to be connected to the first fixed side member by a third corner connector assembly, a second head panel adapted to be connected to the second fixed side member by a fourth corner connector assembly, and a central head panel adapted to receive the first head panel and the second head panel with the first head panel and the second head panel being movable relative to the central head panel to adjust a length of the head assembly; and the first corner connector assembly comprising a corner connector having a top having a pair of projections extending downwardly from the top, a pair of walls extending downwardly from the top, a central portion extending downwardly from the top with the central portion having an aperture, a central connector having an aperture, a locking device for connecting the central portion to the corner connector.

10. The adjustable bed base of claim 9 wherein the central foot panel comprises a slot and the first foot panel comprises an aperture with the slot being configured to align with the aperture.

11. The adjustable bed base of claim 10 further comprising a locking device adapted to be inserted into the slot and the aperture for securing the central foot panel to the first foot panel.

12. The adjustable bed base of claim 9 wherein the central head panel comprises a pair of slots, the first head panel comprises a pair of apertures, and the second head panel comprises a pair of apertures with all of the slots being configured to align with all of the apertures.

13. The adjustable bed base of claim 9 wherein the central foot panel comprises a pair of slots, the first foot panel comprises a pair of apertures, and the second foot panel comprises a pair of apertures with the slots of the central foot panel and the apertures of the first foot panel being configured to align with each other and the slots of the central foot panel and the apertures of the second foot panel being configured to align with each other.

14. The adjustable bed base of claim 13 further comprising a first locking device adapted to be inserted into the aligned slots of the central foot panel and the aligned apertures of the first foot panel for securing the central foot panel to the first foot panel and a second locking device adapted to be inserted into the aligned slots of the central foot panel and the aligned apertures of the second foot panel for securing the central foot panel to the second foot panel.

15. The adjustable bed base of claim 9 wherein the central head panel comprises a pair of slots, the first head panel comprises a pair of apertures, and the second head panel comprises a pair of apertures with the slots of the central head panel and the apertures of the first head panel being configured to align with each other and the slots of the central head panel and the apertures of the second head panel being configured to align with each other.

16. An adjustable bed base comprising:

a first fixed side member having a bottom plate having a pin;

a second fixed side member;

an adjustable foot assembly comprising a first foot panel having a bottom plate having an aperture adapted to be connected to the first fixed side member by positioning the pin of the first fixed side member through the aperture of the first foot panel, a second foot panel adapted to be connected to the second fixed side member, a central foot panel adapted to receive the first foot panel and the second foot panel with the first foot panel and the second foot panel being movable relative to the central foot panel to adjust a length of the foot assembly, and a pair of indicators for identifying when the first foot panel and the second foot panel have been adjusted to a predetermined position;

an adjustable head assembly comprising a first head panel adapted to be connected to the first fixed side member, a second head panel adapted to be connected to the second fixed side member, a central head panel adapted to receive the first head panel and the second head panel with the first head panel and the second head panel being movable relative to the central head panel to adjust a length of the head assembly, and a pair of indicators for identifying when the first head panel and the second head panel have been adjusted to a predetermined position; and a corner connector assembly for connecting the adjustable foot assembly to the first fixed side member, the corner connector assembly comprising a corner connector having a top having a pair of protections extending downwardly from the top, a pair of walls extending downwardly from the top, a central portion extending downwardly from the top with the central portion having an aperture, a central connector having an aperture, and a locking device for connecting the central portion to the corner connector.

17. The adjustable bed base of claim 16 wherein the central foot panel comprises a pair of slots, the first foot panel comprises a pair of apertures, and the second foot panel comprises a pair of apertures with the slots of the central foot panel and the apertures of the first foot panel being configured to align with each other and the slots of the central foot panel and the apertures of the second foot panel being configured to align with each other.

18. The adjustable bed base of claim 16 wherein the central head panel comprises a pair of slots, the first head panel comprises a pair of apertures, and the second head panel comprises a pair of apertures with the slots of the central head panel and the apertures of the first head panel being configured to align with each other and the slots of the central head panel and the apertures of the second head panel being configured to align with each other.

19. The adjustable bed base of claim 16 wherein the adjustable foot assembly further comprises a second pair of indicators for identifying when the first foot panel and the second foot panel have been adjusted to a second predetermined position.

20. The adjustable bed base of claim 16 wherein the adjustable head assembly further comprises a second pair of indicators for identifying when the first head panel and the second head panel have been adjusted to a second predetermined position.

* * * * *